US005814939A

United States Patent [19]

Chu et al.

[11] Patent Number: 5,814,939

[45] Date of Patent: Sep. 29, 1998

[54] MECHANICALLY TUNABLE MAGNETRON INJECTION GUN (MIG)

[76] Inventors: Kwo R. Chu, 48-1 West Yuan, National Tsing Hua University, Hsinchu, Taiwan; Larry R. Barnett, 241 Normandy Rd., Normandy, Tenn. 37360; Chaoen Wang, 2F, 50 Lane 17, Tai Shun St., Taipei, Taiwan; Yih S. Yeh, 4F, 27 Lane 87, Sheh Jeng Rd., Taipei, Taiwan; Tze T. Yang, 14F, 35-1 Tian Mei St., Sec. 3, Hsinchu, Taiwan; Han Y. Chen, 49 Jung Cheng St., Hua Lien, Taiwan; Shih H. Chen, P.O. Box 19-136, Hsinchu, Taiwan; Yi C. Tsai, 58-6 Lungkang, Tungshih, Chiai, Taiwan; Trine Y. Dawn, 55 West Yuan, National Tsing Hua University, Hsinch, Taiwan

[21] Appl. No.: 600,016

[22] Filed: Feb. 12, 1996

[51] Int. Cl.[6] ..... H01J 23/075

[52] U.S. Cl. ..... 315/5.31; 313/454; 313/455; 313/459

[58] Field of Search ..... 315/4, 5, 3, 5.29, 315/5.31, 5.33; 313/454, 455, 459; 330/44, 45; 331/79, 81

[56] References Cited

U.S. PATENT DOCUMENTS

| | | | |
|---|---|---|---|
| 2,208,406 | 7/1940 | Benedict | 313/459 X |
| 2,396,802 | 3/1946 | Mouromtseff et al. | 315/5.33 |
| 2,418,317 | 4/1947 | Runge | 313/459 |
| 3,197,665 | 7/1965 | Cope | 313/459 X |
| 3,997,807 | 12/1976 | Riddle et al. | 313/459 X |
| 4,445,070 | 4/1984 | Wachtel | 315/4 |
| 4,495,442 | 1/1985 | Minami | 315/3 |
| 4,562,380 | 12/1985 | Dionne | 315/4 |
| 5,686,785 | 11/1997 | Mouchan et al. | 313/454 X |

OTHER PUBLICATIONS

"Stabilization of Absolute Instabilities in the Gyrotron Traveling Wave Amplifier", Chu, K.R. et al., Physical Review Letters, vol. 74, No. 7, 13 Feb. 1995, pp. 1103–1106.

Baird and Lawson, Dec. 1986, "Magnetron Injection Gun (MIG) Design for Gyrotron Applications", Int. J. Electron., 61, pp. 953–967.

Schriever and Johnson, "A Rotating Beam Waveguide Oscillator" Proc. IEEE, 54, pp. 2029–2030, Dec. 1966.

Waters, "A Theory of Magnetron Injection Guns", IEEE Transact. on Electron Devices, Jul. 1963, pp. 226–234.

Gaponov, et.al., Nov. 1965, "Induced Synchrotron Radiation of Electrons in Cavity Resonators", JETP Lett., 2, pp. 267–269.

*Primary Examiner*—Benny T. Lee

[57] ABSTRACT

A mechanically tunable magnetron injection gun (MIG) provides an annular, relativistic beam of electrons for injection into an axially aligned magnetic field of a gyrotron-class device. The electron emitter encircles a center electrode. Turning a knob adjusts the center electrode's axial position relative to the rest of the cathode. The adjustable center electrode provides an effective means for local field adjustment. The center electrode is located in a particularly sensitive electric field region and adjusts the electric field so as to tune the electron beam from the inside out. Adjusting the center electrode position while the device is in operation is a means for providing mechanical tunability (with respect to beam quality and transverse-to-axial velocity ratio) for the MIG. The mechanical tunability feature provides the MIG with an extra degree of freedom for the optimization of the beam quality, it provides the versatility of operation in a much greater parameter space, it can be used to compensate for machining errors and thermal deformations, and it can provide tunability for single anode MIGs.

1 Claim, 8 Drawing Sheets

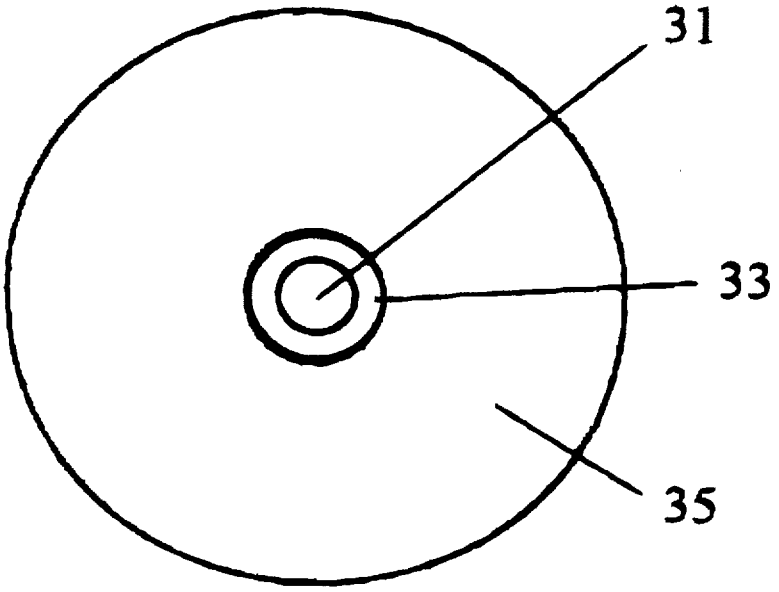
Fig. 2-A
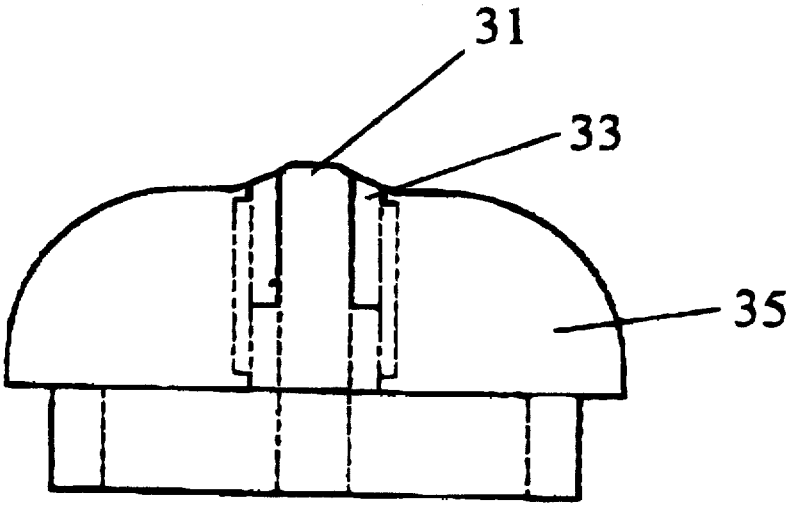
Fig. 2-B

MECHANICALLY TUNABLE MAGNETRON INJECTION GUN (MIG)

BACKGROUND-FIELD OF INVENTION

This invention relates to Magnetron Injection Guns (MIGs), specifically to a mechanically tunable MIG which is used to supply an electron beam for the generation of electromagnetic radiation by gyrotron devices.

BACKGROUND-DESCRIPTION OF PRIOR ART

The cyclotron resonance maser (or gyrotron) class of device has been demonstrated to be an efficient means for generating r.f. power at millimeter wavelengths without intricate r.f. circuitry. In brief, the principle of operation is that electrons of a hollow monoenergetic beam whose cyclotron frequency is determined by a strong, uniform axial magnetic field interact mainly with the transverse r.f. fields of a traveling wave within a cylindrical waveguide. Power extraction from the electron beam occurs in the waveguide when the wave frequency equals the Doppler shifted electron cyclotron frequency.

Electron beam quality (characterized by the axial velocity spread divided by the average axial velocity, $\Delta v_Z/v_Z$) is a major factor affecting the performance of the gyrotron class of device. Low velocity spread is critical to the efficient performance of high power millimeter wave amplifiers such as gyroklystrons, gyro-TWTs, and gyro-peniotrons.

The most common method for providing an electron beam for the gyrotron class of device is the MIG. In a MIG, the electrons are emitted from a thermionic cathode. An electric field extends between the cathode and the anode, and a static magnetic field is applied in the axial direction of the anode and cathode. As soon as the electrons leave the cathode, they experience a crossed electric and magnetic field producing the spiral motion of the electron beam. The crossed electric and magnetic field prevents the electrons from reaching the anode. The electrons are then passed through a region of adiabatic magnetic field compression, where the ratio of transverse energy to parallel energy increases. The electrons form a large annular beam with the electrons executing small cyclotron orbits as required for the cyclotron resonance interaction.

Principles of a MIG were disclosed by W. E. Waters, "A Theory of Magnetron Injection Guns", IEEE Transaction on Electron Devices, July 1963, pp. 226–234. The small-orbit MIG configuration was first tested in the United States by Dickerson and Johnson (1964) and was used by Schriever and Johnson (1966) to produce a cyclotron wave for a backward wave oscillator (BWO). Gaponov et al. (1965) in the Soviet Union were the first to use this type of gun in gyrotron oscillators.

Most MIGs are of the double anode design rather than the single anode design. In the two anode design the MIG is made up of a first anode, also known as the modulation anode or the intermediate electrode, and a second anode further downstream. The double anode design has the advantage that the voltage between the first anode and the cathode can be electronically tuned to improve beam quality as well as other beam parameters. A single anode design has the advantage that it can be used to create a smoothly varying E-field in the cathode-anode region to better approximate adiabatic flow conditions in the acceleration region of the MIG. Also, the single anode design is easier to fabricate. However, the single anode design loses the tunability provided by the modulation anode in the double anode design.

Except for the addition of the tunability feature and the resulting new, unexpected results, the theory behind the mechanically tunable MIG and the design procedure is the same as that for the conventional MIG reported in Baird, J. M., and Lawson, W., 1986, "Magnetron Injection Gun (MIG) Design for Gyrotron Applications", Int. J. Electron., 61, 953–967. In particular, the preferred embodiment of the mechanically tunable MIG adds the tunability feature to a design similar to that of the single anode design described starting on page 961 of Baird's paper.

The common practice is to design MIGs using simulation codes. The MIG parameters are varied until an optimized design is obtained. However, due to machining errors, thermal deformations, and coupling to the circuit, actual MIGs do not perform to the specifications they are designed for. Users of currently available MIGs must try to get the fabricated MIG to perform closer to the simulation values by physically modifying the circuit or else by changing the magnitude of the electric or magnetic fields. These techniques fail to achieve the optimized predictions of the computer simulation. Single anode MIGs do not even provide the option of electronically tuning the beam by varying the first anode's voltage.

Prior art patents point to the shortcomings of MIG performance and attempt alternate solutions for supplying beams for the gyrotron class of device. U.S. Pat. No. 4,445,070 of Wachtel discloses an electron gun for producing spiral electron beams and gyrotron devices including same, U.S. Pat. No. 4,562,380 of Dionne discloses a tilt-angle electron gun, and U.S. Pat. No. 4,495,442 of Minami discloses a cold-cathode magnetron injection gun. All of these inventions point to problems with MIG performance and introduce alternatives to conventional MIGs. However, no prior art comes up with the novel solution of a mechanically tunable MIG to allow the fabricated MIG to perform closer to the simulation values as well as allowing an extra degree of freedom to provide the versatility of operation in a much greater parameter space.

In the electron beam generated by the magnetron injection gun, the velocity of the individual electrons is close to the velocity of light, so that relativistic treatment is necessary. The electron beam generator of such a relativistic electron beam is apparently different from conventional low voltage electron accelerators and is used in different fields.

Electron beams suitable for gyrotron type of r.f. interaction require electron guns that differ substantially from those employed in conventional O-type microwave tubes. Because power conversion involves the rotational kinetic power of the gyrobeam, beam formation for this newer class of devices must generate a transverse-to-axial velocity ratio, $\alpha$, and should have a low longitudinal velocity spread, $\Delta v_Z/v_Z$, for better device performance.

SUMMARY OF THE INVENTION

The present invention improves on prior art MIG's by providing a mechanically tunable MIG which provides an annular, relativistic beam of electrons for injection into an axially aligned magnetic field of a gyrotron-class device. The electron emitter encircles a center electrode. Turning a knob adjusts the center electrode's axial position relative to the rest of the cathode. The adjustable center electrode provides an effective means for local field adjustment. The center electrode is located in a particularly sensitive electric field region and adjusts the electric field so as to tune the electron beam from the inside out. Adjusting the center electrode position while the device is in operation is a means for providing mechanical tunability (with respect to beam quality and transverse-to-axial velocity ratio) for the MIG.

The mechanical tunability feature provides the MIG with an extra degree of freedom for the optimization of the beam quality, it provides the versatility of operation in a much greater parameter space, it can be used to compensate for machining errors and thermal deformations, and it can provide tunability for single anode MIGs.

The present invention can be described as a mechanically tunable magnetron injection gun of which an annular shaped electron beam is produced of electrons moving in helical trajectories in an axial magnetic field ($B_z$) by electric and magnetic field forces for which the electrons have perpendicular and axial velocity to the magnetic field where the ratio of perpendicular to axial velocity and distribution of the perpendicular to axial velocity ratios over all the electrons is made adjustable by means of a center electrode mechanically moveable in the axis direction by which the electric field in front of the electron emitting annular emitter surrounding the center moveable electrode is changed in shape to alter the trajectories of the electrons.

The present invention can also be described as a mechanically tunable magnetron injection gun of which an adjustable annular shaped electron beam is produced of electrons moving in helical trajectories in an axial magnetic field ($B_z$) by electric and magnetic field forces for which the electrons have perpendicular and axial velocity to the magnetic field where the ratio of perpendicular to axial velocity and the distribution of perpendicular and axial velocity to the magnetic field where the ratio of perpendicular to axial velocity and the distribution of the perpendicular to axial velocity ratios over all the electrons is made adjustable by means of a center electrode mechanically moveable in the axis direction by which the electric field in front of the electron emitting annular emitter surrounding the center moveable electrode is changed in shape to alter the trajectories of the electrons comprising: an axially symmetric system of a cathode assembly, separated from an annular anode through which the electron beam passes, consisting of a center electrode surrounded by an annular electron emitter surrounded by an outer electrode, a linear motion feedthrough mechanically linked by a sliding shaft to the center electrode of the cathode assembly, the cathode assembly mounted on a stem through which the sliding shaft passes, the whole assembly mounted to a high voltage base plate supported by a cylindrical ceramic insulator, the device utilizing the electron beam attached, the whole assembly being sealed to support high vacuum inside, the whole electron gun assembly being immersed in an axial magnetic field ($B_z$), by which the ratio of perpendicular to axial velocity and the distribution of the ratios of perpendicular to axial velocities of all the electrons is made adjustable by axial motion of the linear motion feedthrough, sliding shaft, and center electrode. The device utilizing the adjustable annular electron beam of electrons moving in helical trajectories in an axial magnetic field ($B_z$) is a gyrotron traveling wave amplifier amplifying microwave frequency electromagnetic waves to high output power as is described in prior art where the amplifying characteristics of the gyrotron traveling wave amplifier consisting of the output power, gain, efficiency, and bandwidth are made adjustable and improved over prior art by means of mechanical adjustment by axial motion of the linear motion feedthrough, sliding shaft, and center electrode. The device utilizing the adjustable annular electron beam of electrons moving in helical trajectories in an axial magnetic field ($B_z$) is any type of gyrotron amplifier, gyrotron oscillator, cyclotron maser, peniotron, microwave amplifier, or microwave oscillator producing microwave frequency electromagnetic waves to high output power where the output power, gain, efficiency, and bandwidth of said device are made adjustable and improved by means of mechanical adjustment by axial motion of the linear motion feedthrough, sliding shaft, and center electrode.

Accordingly, several objects and advantages of the present invention are:

(a) to obviate the above-mentioned shortcomings of the prior art by providing an improved mechanically tunable MIG.

(b) to provide a mechanically tunable MIG in order to provide an extra degree of freedom for the optimization of the beam quality.

(c) to provide a mechanically tunable MIG in order to compensate for machining errors.

(d) to provide a mechanically tunable MIG in order to provide the versatility of operation in a much greater parameter space.

(e) to provide an improved electron beam source for gyrotron class devices.

Going to a single anode design from a double anode design results in ease of construction and other advantages at the expense of losing the tunability (with respect to beam quality and transverse-to-axial velocity ratio) provided by the modulation anode. Therefore, another object and advantage of the mechanical tunability feature is:

(f) to allow us to regain the tunability of the double anode design while maintaining the advantages of a single anode design.

The emitter of a MIG often operates at very high temperatures (e.g. 1150° C.). This causes mechanical distortions due to the high thermal gradient during operation. Therefore, another object and advantage of the mechanical tunability feature is:

(g) to compensate for mechanical distortions during operation caused by the thermal gradient.

Our mechanical tunability feature is qualitatively different from the voltage tuning which the modulation anode provides for double anode MIGs. The modulation anode shapes the electric field from outside the annular electron beam. The mechanical tunability feature shapes the electric field in the more sensitive region inside the annular electron beam. Therefore, another object and advantage is:

(h) to provide a tuning mechanism which is qualitatively different from that provided by the modulation anode and to provide a tuning mechanism which is more sensitive than that provide by the modulation anode.

The present invention works very well. The present invention was first revealed in the article entitled, "Stabilization of Absolute Instabilities in the Gyrotron Traveling Wave Amplifier", by Chu, Barnett, Chen, Chen, Wang, Yeh, Tsai, Yang and Dawn in Physical Review Letters, Vol. 74, No. 7, 13 Feb. 1995. This article presents the results of using the mechanically tunable MIG to supply an electron beam for a gyrotron traveling Wave Amplifier (gyro-TWT). The experiment demonstrated the highest power (60 kW)-bandwidth (4 GHz) product of any Kaband amplifier to date.

Other objects, advantages, and novel features of the present invention will become apparent from the detailed description of the invention.

BRIEF DESCRIPTION OF THE DRAWINGS

In the drawings, closely related figures have the same number but different alphabetic suffixes.

FIG. 2A is a front view of the cathode assembly.

FIG. 2B is a side view of the cathode assembly.

Figure 1:
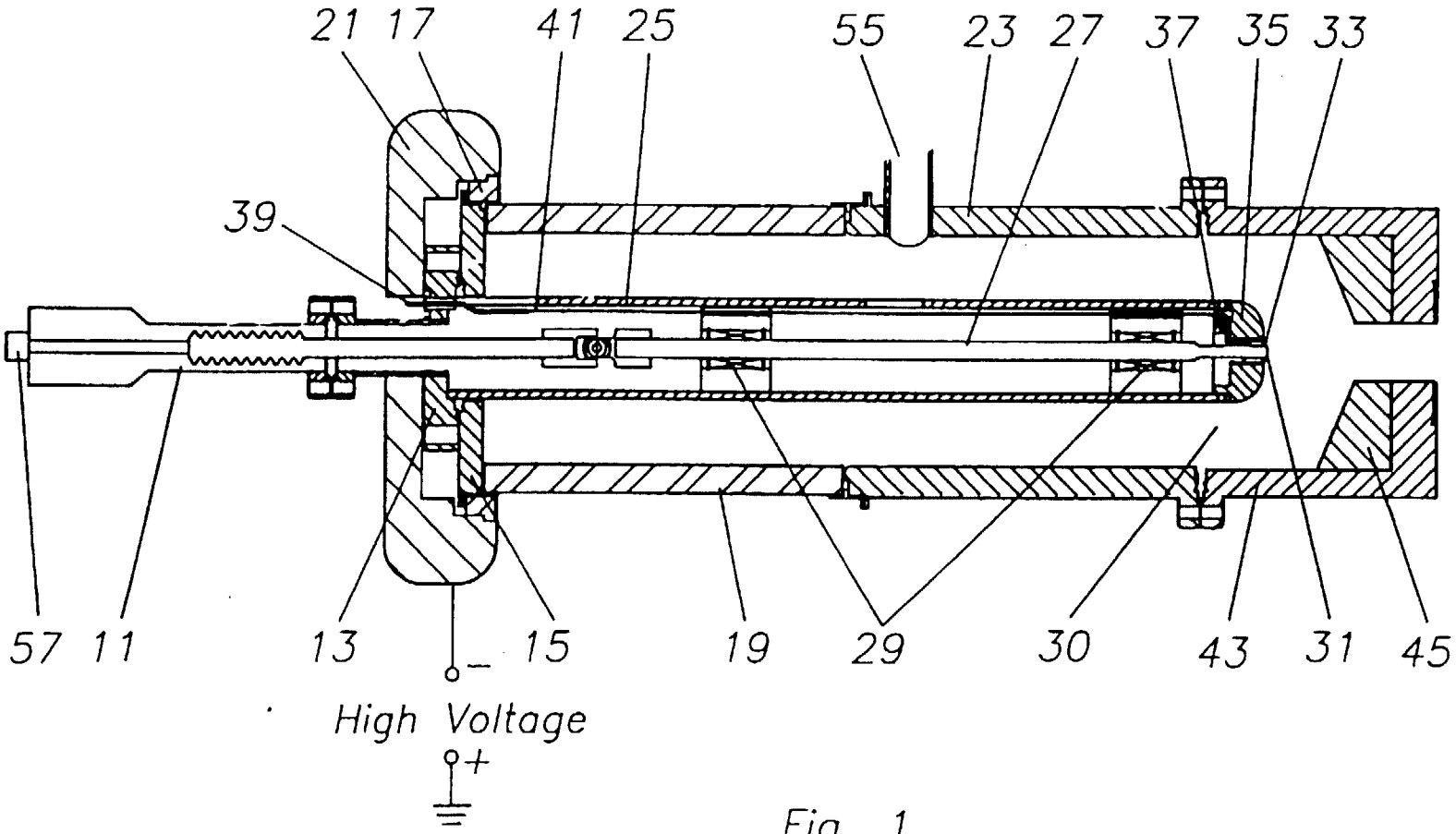
FIG. 1 is an enlarged side view of an essential portion of the MIG shown in FIG. 3, but excluding the circuit of FIG. 3.

DETAILED DESCRIPTION OF THE INVENTION:

This invention makes use of the following parts and features for description: linear motion feedthrough 11, vacuum flange 13, base plate 15, stainless steel ring 17, ceramic insulator 19, stainless steel corona ring 21, stainless steel vacuum container side wall 23, stem 25, sliding shaft 27, linear ball bearing 29, cathode assembly 30, center electrode 31, electron emitter 33, outer electrode 35, potted heater 37, heater power electrical feedthrough 39, electrical conductor 41, stainless steel vacuum container 43, anode 45, mechanically tunable MIG 47, Gyrotron Traveling Wave Amplifier (gyro-TWT) circuit 49, input coupler 51, output coupler 53, pumping port 55, rotating knob 57, superconducting magnet with 6 sets of coils 59, electron trajectories 61 and microwave frequency electron beam device 63.

Figure 3:
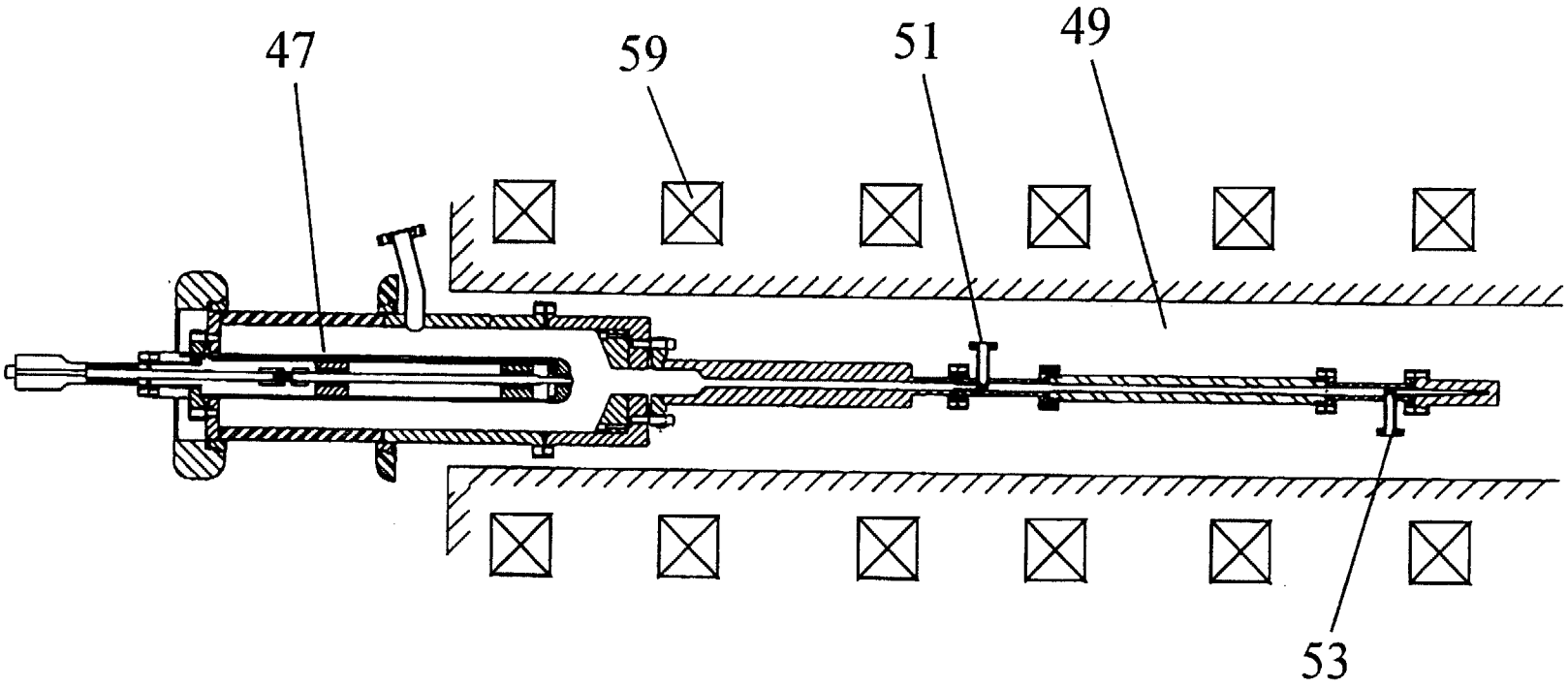
FIG. 3 is a schematic view of a mechanically tunable MIG according to the present invention attached to a gyro-TWT circuit.

FIG. 1 shows an enlarged view of an essential portion of a mechanically tunable MIG 47 as shown in FIG. 3. The following description generally follows FIG. 1 from left to right. Referring to FIG. 1, a linear motion feedthrough 11 is connected with a high vacuum weld to a stainless steel vacuum flange 13. Vacuum flange 13 is bolted onto a stainless steel base plate 15 to provide a high vacuum connection. A stainless steel ring 17 is brazed to a ceramic insulator 19 and is connected with a high vacuum weld to base plate 15. A stainless steel corona ring 21 is fit around stainless steel ring 17. The stainless steel corona ring 21 is held at a high value of negative voltage as shown by the conventional voltage symbol shown in FIG. 1 where the symbols (−) and (+) are used in the conventional manner to indicate that the stainless steel corona ring 21 is held at a high negative voltage (−) with respect to the positive ground voltage (+). A stainless steel vacuum container side wall 23 is brazed to ceramic insulator 19. A vacuum pump extracts air through a pumping port 55 passing through vacuum container side wall 23.

A stem 25 is welded to vacuum flange 13. Linear motion feedthrough 11 runs along the side axis of stem 25 and connects to a sliding shaft 27. Sliding shaft 27 continues along the inside axis of stem 25, passing through two linear ball bearings 29. Linear ball bearings 29 fit against the inner walls of stem 25. The furthest tip of sliding shaft 27 is attached to a molybdenum cathode nose or center electrode 31. A ring-shaped electron emitter 33 is embedded in a stainless steel outer electrode 35 and surrounds center electrode 31. Outer electrode 35, electron emitter 33, and center electrode 31 form a cathode assembly 30 and are all aligned to the same center axis. A potted heater 37 is embedded in electron emitter 33. FIGS. 2A and 2B provide a front and a side view, respectively, of electron emitter 33 and center electrode 31 as embedded in outer electrode 35.

Referring again to FIG. 1, a high vacuum/low voltage electrical feedthrough or heater power electrical feedthrough 39 passes through vacuum flange 13 into the high vacuum region inside stem 25. An electrical conductor 41 passes through heater power electrical feedthrough 39 and extends along the inside of stem 25. The inside end of electrical conductor 41 attaches to potted heater 37. A stainless steel vacuum container 43 is bolted to vacuum container side wall 23 to provide a high vacuum fit. A copper anode 45 is fitted into vacuum container 43.

In FIG. 3, a mechanically tunable MIG 47 is mounted on a gyro-TWT circuit 49. Referring to FIG. 3, a superconducting magnet with six (6) sets of coils 59 surrounds MIG 47 and circuit 49. An input coupler 51 enters the circuit and an output coupler 53 leaves the circuit.

The manner of using mechanically tunable MIG 47 is the same as that for conventional MIGs except for the mechanical tunability feature. The tunability feature works in the manner which follows. Referring to FIG. 1, turning a knob 57 causes linear motion feedthrough 11 to move sliding shaft 27 along the axis. Linear ball bearings 29 do not allow for rotation of sliding shaft 27, but only allow for axial motion. Because center electrode 31 is directly attached to sliding shaft 27, the axial motion of center electrode 31 is directly proportional to the rotation of knob 57.

Mechanically tunable MIG 47 (see FIG. 3) provides an annular, relativistic beam of electrons in helical motion in an axial magnetic field with perpendicular and axial velocity to the magnetic field for injection into an axially aligned magnetic field of a gyrotron-class device. Adjustable center electrode 31 (see FIG. 1) provides an effective means for local field adjustment. Center electrode 31 is located in a particularly sensitive electric field region and tunes the electron beam from the inside out. Adjusting the position of center electrode 31 while the device is in operation is a means for providing mechanical tunability (with respect to beam quality and transverse-to-axial velocity ratio) for MIG 47.

Figures 6A, 6B, 6C:
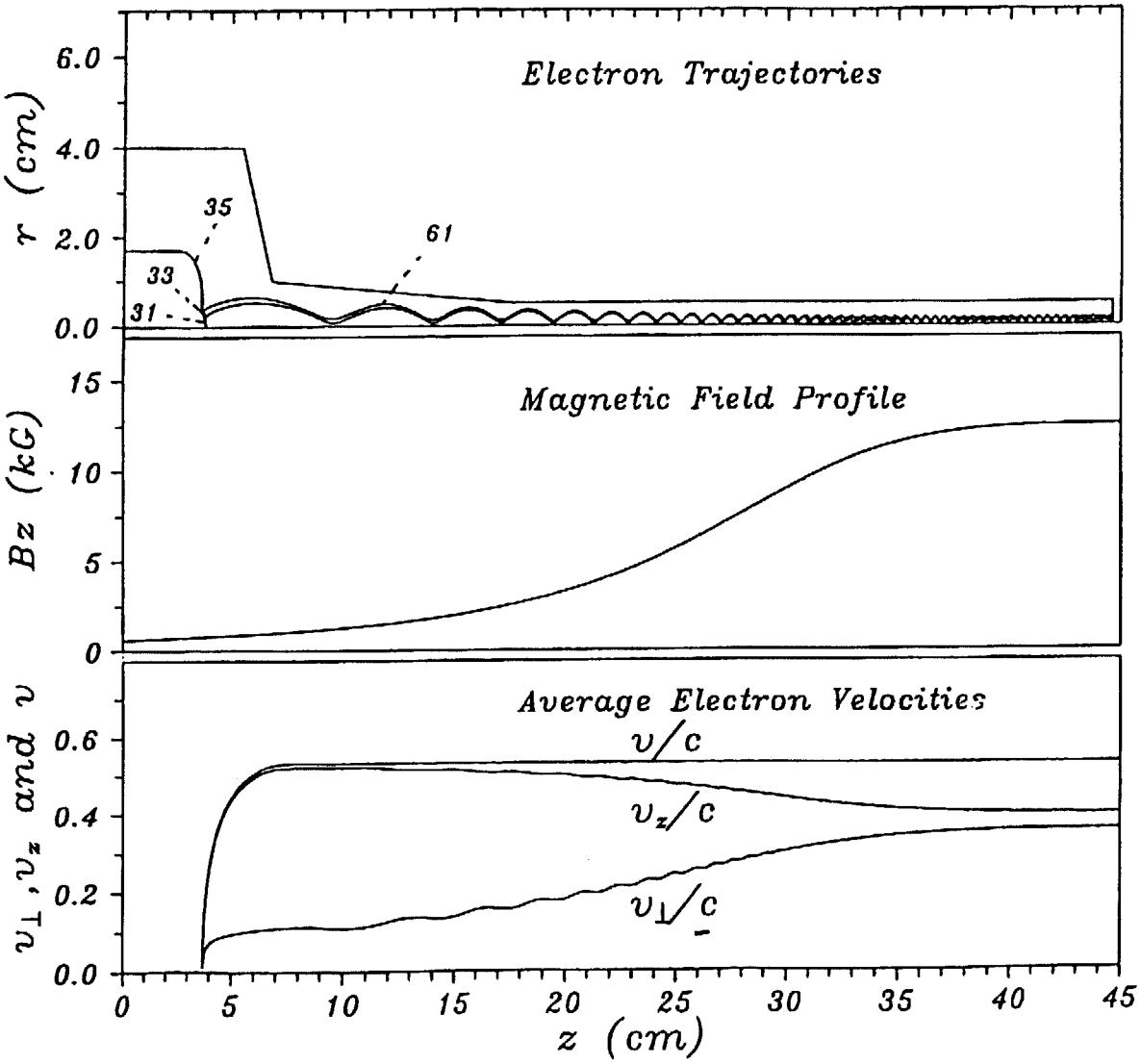
FIG. 6A displays the electron trajectories as they move axially.
FIG. 6B shows the axial magnetic field strength ($B_Z$) as a function of the axial position z.
FIG. 6C shows the variations of the averaged electron velocities (total velocity v, axial velocity $v_z$, and perpendicular velocity $v_{TM}$) as functions of z.

FIGS. 6A to 6C show schematically the axial magnetic field profile along the axis and the beam acceleration processes near cathode assembly 30 and the magnetic compression processes down the axis. In FIG. 6A, reference number 31 once again represents the center electrode, reference number 33 once again represents the electron emitter, reference number 35 once again represents the outer electrode and reference number 61 represents electron trajectories. The ordinate represents radial distance (Z) from the center axis of the MIG 47, expressed in units of centimeters (cm). The abscissa represents distance (Z) measured along the center axis of the MIG 47, also expressed in units of centimeters (cm). In FIG. 6B, the axial magnetic field ($B_z$) is shown on the ordinate and is expressed in units of kilogauss (kG), and the abscissa represents distance (Z)

measured along the center axis of the MIG 47, expressed in units of centimeters (cm). Thus FIG. 6B represents a magnetic field profile of the magnetic field along the center axis of MIG 47. In FIG. 6C, $v\perp$ represents the average electron transverse velocity, $v_z$ represents average electron axial velocity and v represents average absolute electron velocity. All three values are normalized to the speed of light, c. Once again, the abscissa represents distance (Z) measured along the center axis of the MIG 47, expressed in units of centimeters (cm).

Figure 7:
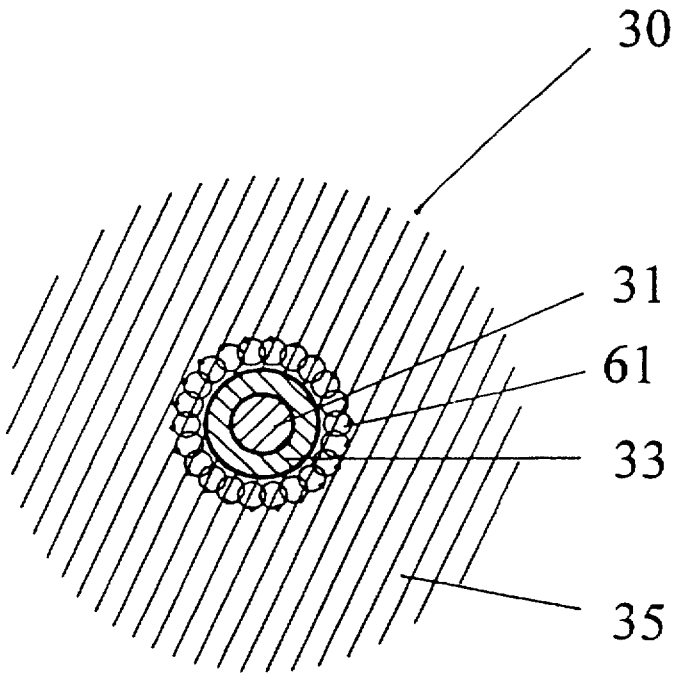
FIG. 7 shows a schematic diagram of what the electron beam and cathode look like from a position looking down the central axis.

FIG. 7 shows a schematic diagram of what the final electron beam (projections of helical electron trajectories on the cross-sectional plane) and cathode assembly 30 looks like from a position looking down the central axis. Center electrode 31 adjusts the field from inside the hollow annular electron beam and thus tunes the electron beam from the inside towards the outside of the beam. In FIG. 7, reference number 33 once again represents the electron emitter, reference number 35 once again represents the outer electrode, and reference number 61 once again represents the electron trajectories.

Figure 5A:
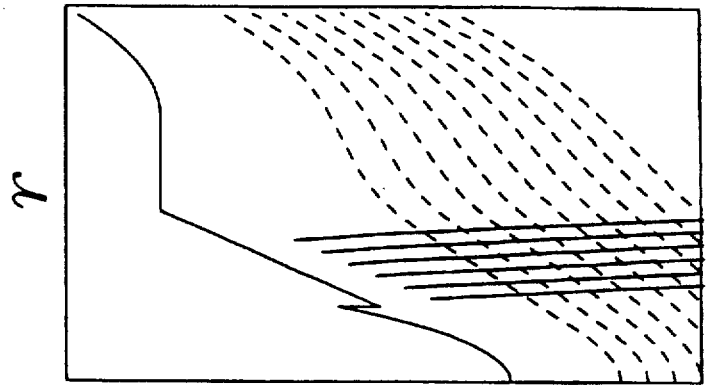
FIGS. 5A to 5C show computer simulation results for the equal-potential lines and electron trajectories near the cathode tip as the cathode center electrode position is varied.
Figure 5B:
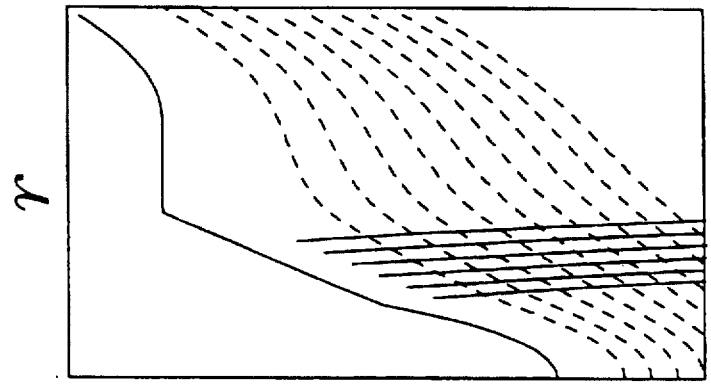
Figure 5C:
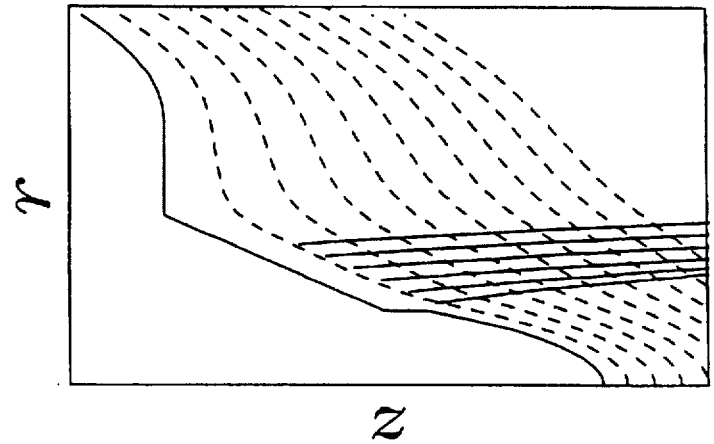

FIGS. 5A to 5C show results of computer calculations of the equal-potential lines—and electron trajectories 61 (straight lines crossing dashed lines) near and in front of cathode assembly 30 as the position of center electrode 31 is varied. It is well known that electric field lines cross perpendicularly to equal-potential lines. The simulation assumes a beam current $I_b$ of 3A. The figures show the local field adjustment and change in electron trajectories as center electrode 31 moves from the relative position of −0.1 mm in FIG. 5A to the relative position of 0.2 mm in FIG. 5C.

Figure 4A:
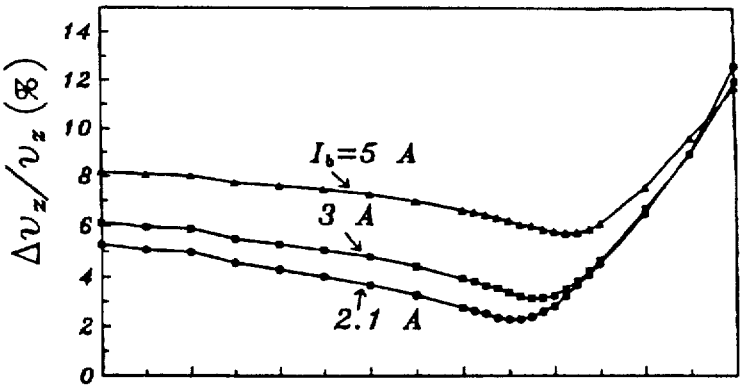
FIG. 4A and FIG. 4B are the simulated beam velocity spread (FIG. 4A) and $\alpha$ value (FIG. 4B) as functions of the axial position of center electrode relative to the rest of cathode assembly.
Figure 4B:
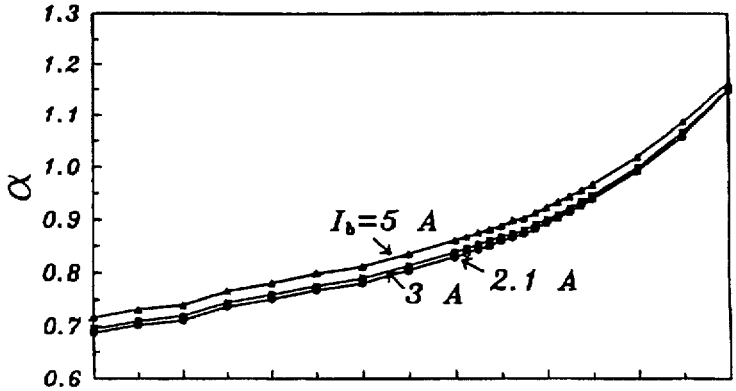

FIGS. 4A and 4B show computer calculated electron trajectory 61 simulations for mechanically tunable MIG 47 for beam currents $I_b$ of 2.1 Amps (2.1 A), 3 Amps (3 A), and 5 Amps (5 A). FIG. 4A shows the simulated beam velocity spread as a function of the axial position of center electrode 31 relative to the rest of cathode assembly 30. This figure indicates the strong sensitivity of the beam quality (characterized by the axial velocity spread $\Delta v_Z/v_Z$) with respect to the axial position of center electrode 31 relative to the rest of cathode assembly 30. The figure indicates how a slight shift of the center electrode 31 position may result in a large variation in beam quality, while the center electrode 31 position for the best beam quality changes with the beam current $I_b$. FIG. 4B shows the simulated transverse-to-axial velocity ratio, $\alpha(=v_\perp/v_Z)$, as a function of the axial position of center electrode 31 relative to the rest of cathode assembly 30. This figure indicates the strong sensitivity of $\alpha$ with respect to the axial position of center electrode 31 relative to the rest of cathode assembly 30. The figure indicates how a slight shift of the center electrode 31 position may result in a large variation in $\alpha$. The center electrode 31 position for a given $\alpha$ is also modestly dependent on $I_b$. Thus the adjustability of the center electrode 31 position provides an extra, and often critical, degree of freedom for the optimization of the beam quality as well as compensation for machining errors and thermal deformations, providing the versatility of operation in a much greater parameter space.

Figure 8:
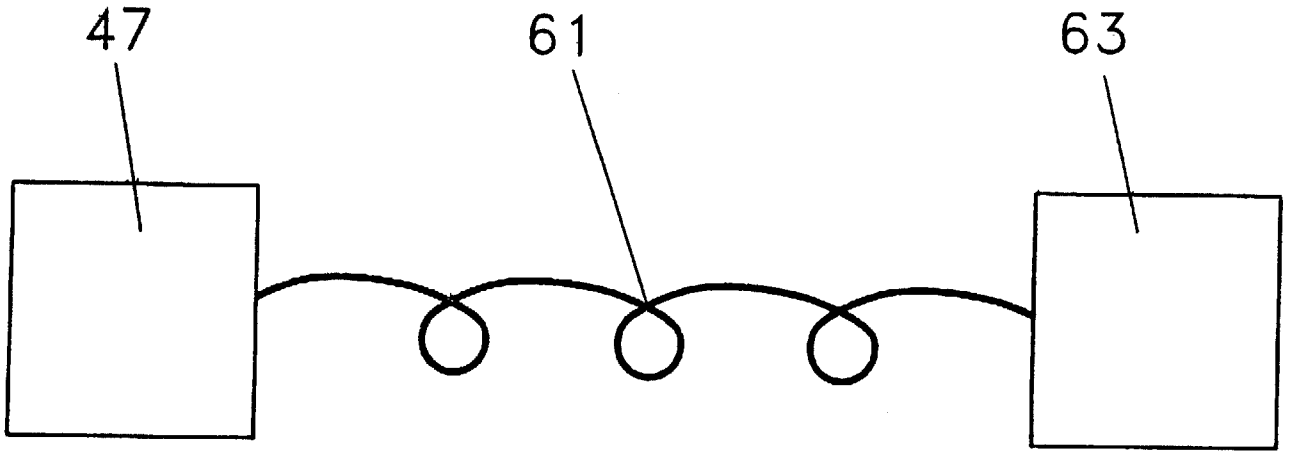
FIG. 8 shows a mechanically tunable MIG being used to provide an electron beam for a microwave frequency electron beam device.

As shown in FIG. 8, mechanically tunable MIG 47 can be used to supply an electron beam with electron trajectories 61 to a microwave frequency electron beam device 63. Such a microwave frequency electron beam device includes one of a gyrotron amplifier, gyrotron oscillator, cyclotron maser, peniotron, microwave amplifier, or microwave oscillator. In FIG. 8, block 63 represents any of the above mentioned microwave frequency electron beam device. Mechanically tunable MIG 47 is attached to microwave frequency election beam device 63 the same way as a known MIGs would be.

Figure 4C:
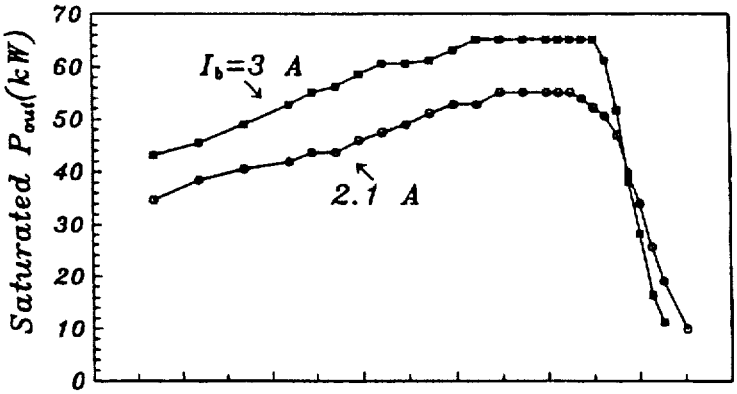
FIG. 4C and FIG. 4D display the measured gyro-TWT output power (FIG. 4C) and gain (FIG. 4D) as functions of the center electrode position.
Figure 4D:
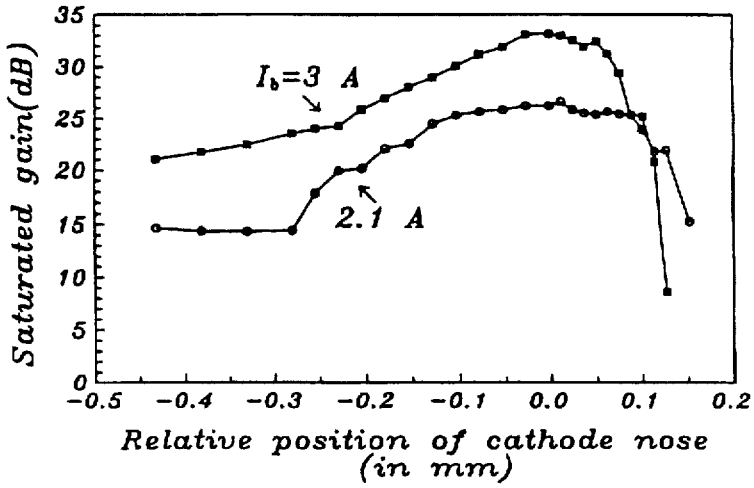

In the successful tests (the results are more fully described in the paper referred to previously, "Stabilization of Absolute Instabilities in the Gyrotron Traveling Wave Amplifier", by Chu et. al.) of mechanically tunable MIG 47, MIG 47 was mounted on a gyro-TWT circuit 49 as shown in FIG. 3. FIGS. 4C and 4D display the actual measured gyro-TWT output power and gain as a function of center electrode 31 position for beam currents $I_b$ of 2.1 Amps (2.1 A) and 3 Amps (3 A). An input coupler 51 enters the circuit and an output coupler 53 leaves the circuit. The output power is measured by the power leaving output coupler 53. The gain is measured by calculating the ratio of the power leaving the circuit through output coupler 53 to the power entering the circuit through input coupler 51. The experiments and the computer simulations were conducted using the parameters shown in TABLE 1. The values for the beam currents used in each of the simulations and experiments are shown in the figures. Note how the experimental gain and output power obtain peak values at the same center electrode 31 position where the computer simulation predicts a minimum axial velocity spread.

TABLE 1

| Design parameters. | |
|---|---|
| freguency (f) | 34.3 GHz |
| beam voltage ($V_b$) | 99.45 kV |
| uniform magnetic field ($B_o$) | 12.69 kG |

Thus the reader will see that the mechanically tunable MIG is an improved electron beam source for the gyrotron class of devices which offers many advantages over previously available traditional MIGs. The mechanically tunable MIG provides an extra degree of freedom for the optimization of the beam quality, it can compensate for machining errors and thermal deformations, and it provides the versatility to operate in a much greater parameter space.

While the above description contains many specificities, these should not be construed as limitations on the scope of the invention, but rather as an exemplification of one preferred embodiment thereof. Many other variations are possible. It is not limited to cathodes used in MIGs. Moreover, the mechanically tunable MIG could have more anodes than the single anode embodiment described herein. The mechanically tunable MIG is also not limited to use with a gyro-TWT as shown herein. The mechanically tunable MIG could be used with any member of the gyrotron class of device. It could also be used in many other applications requiring a helical motion annular relativistic electron beam. Accordingly, the scope of the invention should be determined not by the embodiment illustrated, but by the appended claims and their legal equivalents.

What is claimed to be secured and desired by Letters Patent of the United States is:

1. A mechanically tunable magnetron injection gun, comprising:

a ring-shaped electron emitter for producing a hollow annular electron beam;

said ring-shaped electron emitter embedded in a stainless steel outer electrode;

a center electrode surrounded by said ring-shaped electron emitter;

said outer electrode, said ring-shaped electron emitter and said center electrode providing a cathode assembly;

said cathode assembly being a part of said mechanically tunable magnetron injection gun;

said outer electrode, said ring-shaped electron emitter, said center electrode and said cathode assembly all aligned to a common center axis and providing a cathode assembly configured to be axially symmetric about said common center axis;

a magnetic field oriented parallel to said common center axis;

said ring-shaped electron emitter emitting a hollow annular electron beam, the center of said hollow annular electron beam aligned with said common center axis, said annular electron beam characterized by an electron beam quality and a transverse-to-axial velocity ratio;

a linear motion feedthrough connected with a high vacuum weld to a vacuum flange, said vacuum flange bolted onto a base plate to provide a high vacuum connection, a ring brazed to a ceramic insulator, said ring also connected with a high vacuum weld to said base plate, a corona ring fit around said ring, a vacuum container side wall brazed to said ceramic insulator, a vacuum pump for extracting air through a pumping port passing through a vacuum container side wall, a vacuum container bolted to said vacuum container side well to provide a high vacuum fit, an anode fitted into said vacuum container;

a stem welded to said vacuum flange, said stem extending within said ceramic insulator, said linear motion feedthrough extending within said stem and extending along said common center axis;

said linear motion feedthrough connected to a sliding shaft also aligned along said common center axis, said linear motion feedthrough held in position along said common center axis by linear ball bearings fit against inner walls of said stem;

said sliding shaft attached to said center electrode;

said linear motion feedthrough moving said sliding shaft along said common center axis in response to turning a knob attached to said linear motion feedthrough, wherein said sliding shaft is constrained to purely axial motion along said common center was by means of said linear ball bearings, wherein turning said knob results in purely axial motion of said center electrode along said common center axis and wherein sad purely axial motion of said center electrode along said common center axis is directly proportional to the rotation of said knob;

said center electrode moving purely axially along said common center axis within a hollow region inside of said hollow annular electron beam to tune said hollow annular electron bean from inside said hollow region thereby increasing said electron beam quality and sad transverse-to-axial velocity ratio of said hollow annular electron beam.

* * * * *